US007727018B2

(12) United States Patent
Bright et al.

(10) Patent No.: US 7,727,018 B2
(45) Date of Patent: Jun. 1, 2010

(54) EMI GASKET FOR AN ELECTRICAL CONNECTOR ASSEMBLY

(75) Inventors: Edward John Bright, Middletown, PA (US); Matthew Ryan Schmitt, Middletown, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 12/107,499

(22) Filed: Apr. 22, 2008

(65) Prior Publication Data

US 2009/0264002 A1 Oct. 22, 2009

(51) Int. Cl.
*H01R 13/648* (2006.01)

(52) U.S. Cl. ..... 439/607.28

(58) Field of Classification Search ..... 439/607.28, 439/607.2, 607.19, 636, 939, 79
See application file for complete search history.

(56) References Cited

U.S. PATENT DOCUMENTS

| | | | | |
|---|---|---|---|---|
| 5,317,105 | A * | 5/1994 | Weber | 174/355 |
| 5,779,493 | A * | 7/1998 | Tomita et al. | 439/271 |
| 6,095,862 | A * | 8/2000 | Doye et al. | 439/607 |
| 6,206,730 | B1 * | 3/2001 | Avery et al. | 439/609 |
| 6,287,146 | B1 * | 9/2001 | Avery et al. | 439/607 |
| 6,368,153 | B1 * | 4/2002 | Hwang | 439/607 |
| 6,478,622 | B1 | 11/2002 | Hwang | |
| 6,517,382 | B2 | 2/2003 | Flickinger et al. | |
| 6,533,612 | B1 * | 3/2003 | Lee et al. | 439/607 |
| 6,558,191 | B2 * | 5/2003 | Bright et al. | 439/541.5 |
| 6,612,868 | B2 * | 9/2003 | Hwang | 439/607 |
| 6,709,286 | B1 * | 3/2004 | Korsunsky et al. | 439/557 |
| 6,729,905 | B1 * | 5/2004 | Hwang | 439/607 |
| 6,824,429 | B2 * | 11/2004 | Hwang | 439/607 |
| 6,935,882 | B2 * | 8/2005 | Hanley et al. | 439/372 |
| 7,001,217 | B2 | 2/2006 | Bright et al. | |
| 7,168,971 | B2 * | 1/2007 | Manson et al. | 439/271 |
| 7,413,473 | B2 * | 8/2008 | Wu | 439/557 |
| 7,422,464 | B2 * | 9/2008 | Lloyd et al. | 439/352 |
| 7,438,596 | B2 * | 10/2008 | Philips | 439/607 |
| 7,455,554 | B2 * | 11/2008 | Long | 439/609 |
| 7,473,131 | B2 * | 1/2009 | Dunwoody et al. | 439/607 |
| 7,473,139 | B2 * | 1/2009 | Barringer et al. | 439/609 |
| 7,488,212 | B2 * | 2/2009 | Chen | 439/607 |
| 7,529,521 | B2 * | 5/2009 | Yunker et al. | 455/90.3 |
| 2003/0171033 | A1 * | 9/2003 | Bright et al. | 439/607 |
| 2004/0067682 | A1 * | 4/2004 | Korsunsky et al. | 439/557 |
| 2005/0148223 | A1 * | 7/2005 | Shirk et al. | 439/160 |
| 2007/0128937 | A1 * | 6/2007 | Long et al. | 439/607 |
| 2007/0212942 | A1 * | 9/2007 | Long | 439/608 |

* cited by examiner

*Primary Examiner*—T C Patel
*Assistant Examiner*—Vladimir Imas

(57) ABSTRACT

An electrical connector assembly is provided. The electrical connector assembly includes a cage member configured for mounting in an opening in a panel. The cage member has a compartment for receiving a pluggable electrical component therein. The cage member includes a latch for cooperating with a latch element of the pluggable electrical component. An EMI gasket is mounted on the cage member such that the EMI gasket is electrically connected to the cage member. The EMI gasket is configured to engage the panel when the cage member is mounted in the opening in the panel. The EMI gasket includes a latch interface that engages the latch such that the latch interface is electrically connected to the latch.

22 Claims, 7 Drawing Sheets

EMI GASKET FOR AN ELECTRICAL CONNECTOR ASSEMBLY

BACKGROUND OF THE INVENTION

The subject matter described and/or illustrated herein relates generally to electrical connector assemblies, and more particularly, to electrical connector assemblies for pluggable electrical components.

Some known electrical connector assemblies include a metal cage having one or more ports that each receive a pluggable electrical component therein, such as, but not limited to, a small form factor pluggable (SFP) module. The pluggable components may plug into an electrical connector that is held within the cage and is electrically connected to a host circuit board. An end of the cage that includes the ports for the pluggable electrical components is typically held within a panel of a housing that contains the host circuit board therein. For example, the housing may be a housing for a computer that includes the host circuit board. The end of the cage that is held within the panel typically includes a plurality of springs that are either formed integrally from a wall thereof or are formed from another material and attached to the cage member. The springs extend circumferentially about the end of the cage and exert a spring force on an interior surface of the panel opening that receives the cage end to securely hold the cage end within the panel opening. The springs also facilitate containing electromagnetic interference (EMI) emissions by providing a plurality of contact points that ground the cage to the panel.

Each port of the cage typically includes a spring latch that cooperates with a latch element of the corresponding pluggable electrical component to latch the pluggable electrical component to the cage. However, when the cage is held within the panel, a gap exists between the spring latch and the panel. The gap may allow EMI emissions to leak therethrough during use of the electrical connector assembly.

There is a need for an electrical connector assembly for pluggable electrical components that reduces leakage of EMI emissions in connection with spring latch members.

BRIEF DESCRIPTION OF THE INVENTION

In one embodiment, an electrical connector assembly is provided. The electrical connector assembly includes a cage member configured for mounting in an opening in a panel. The cage member has a compartment for receiving a pluggable electrical component therein. The cage member includes a latch for cooperating with a latch element of the pluggable electrical component. An EMI gasket is mounted on the cage member such that the EMI gasket is electrically connected to the cage member. The EMI gasket is configured to engage the panel when the cage member is mounted in the opening in the panel. The EMI gasket includes a latch interface that engages the latch such that the latch interface is electrically connected to the latch.

Optionally, the latch interface includes a spring. The latch interface may optionally include a pair of extensions that each engages the latch.

Optionally, the EMI gasket comprises an electrically conductive base that engages the cage member.

Optionally, the latch interface closes at least a portion of a gap between the latch and the panel when the cage member is mounted in the opening in the panel.

In another embodiment, an electrical connector assembly is provided. The electrical connector assembly includes a cage member configured for mounting in an opening in a panel. The cage member has a compartment for receiving a pluggable electrical component therein. The cage member includes a latch for cooperating with a latch element of the pluggable electrical component. An electrical connector is at least partially enclosed by the cage member. The electrical connector is configured to electrically connect to the pluggable electrical component when the pluggable electrical component is received within the compartment. An EMI gasket is mounted on the cage member such that the EMI gasket is electrically connected to the cage member. The EMI gasket is configured to engage the panel when the cage member is mounted in the opening in the panel. The EMI gasket includes a latch interface that engages the latch such that the latch interface is electrically connected to the latch.

DETAILED DESCRIPTION OF THE INVENTION

Figure 1:
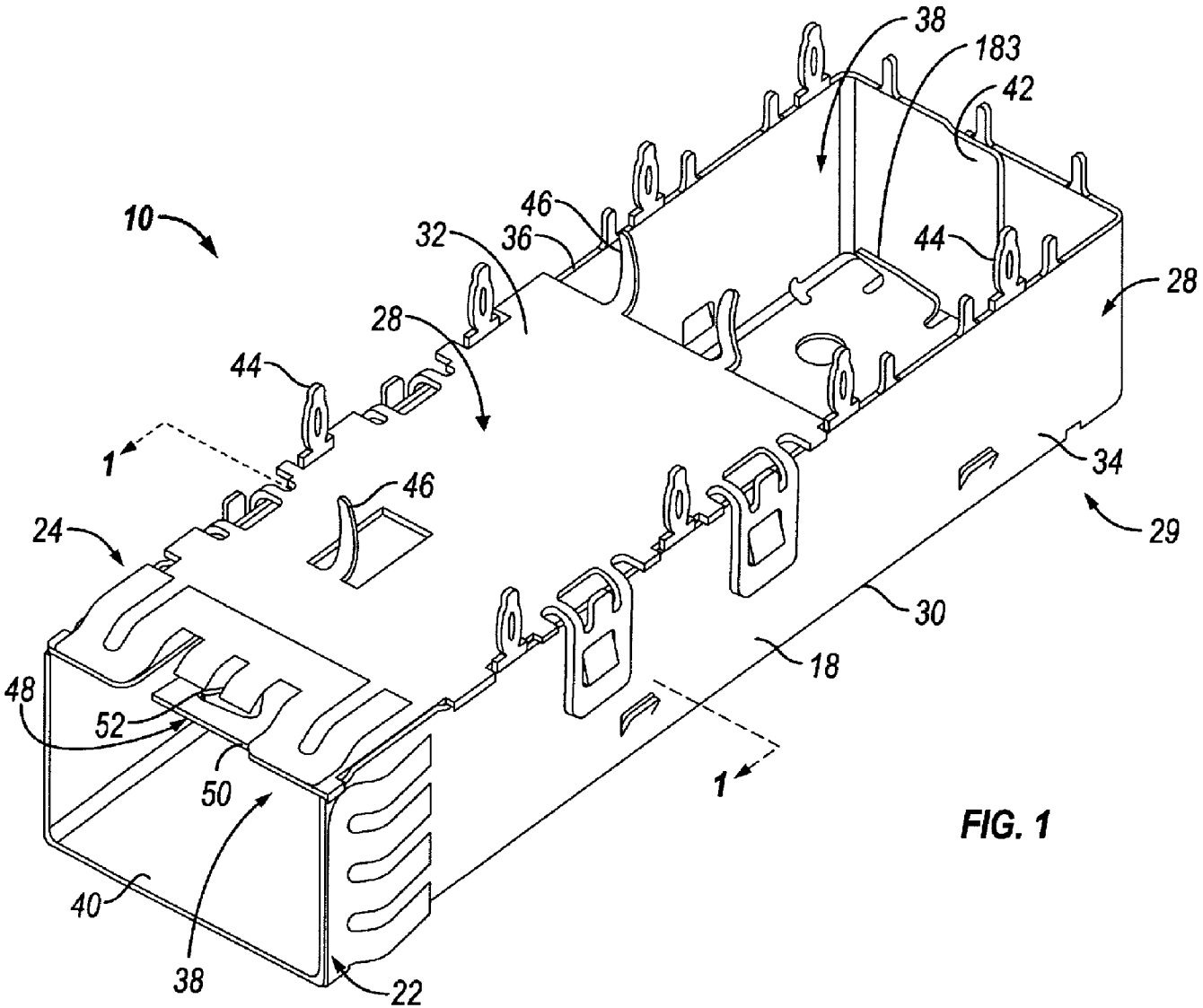
FIG. 1 is a perspective view of an exemplary embodiment of an electrical connector assembly.
Figure 2:
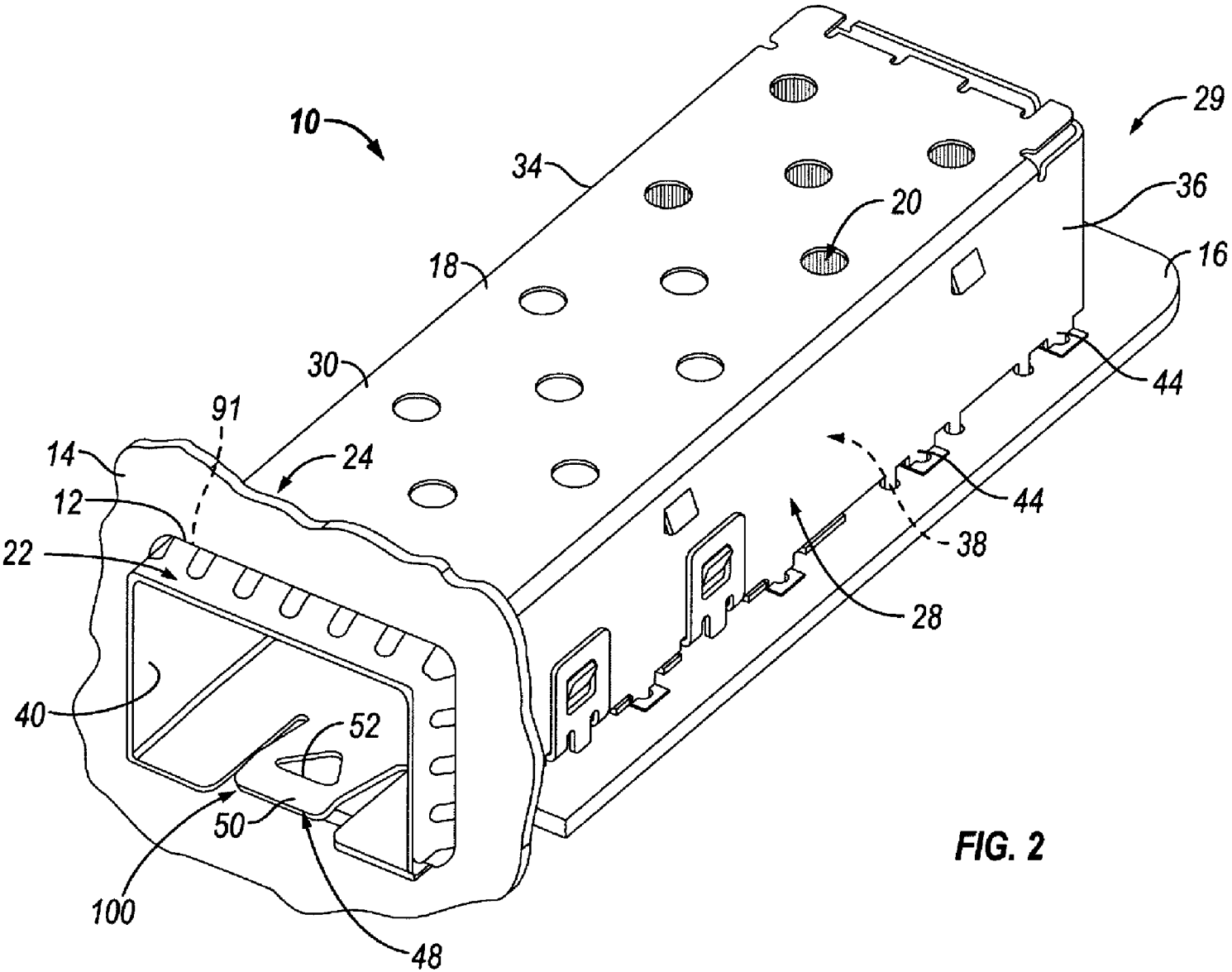
FIG. 2 is a perspective view of the electrical connector assembly shown in FIG. 1 mounted in a panel opening and mounted to a circuit board.

FIG. 1 is a perspective view of an exemplary embodiment of an electrical connector assembly 10. FIG. 2 is a perspective view of the electrical connector assembly 10 mounted in an opening 12 in a panel 14 and mounted on a circuit board 16. The electrical connector assembly 10 includes a shielded cage member 18 having one or more electrical connectors 20 positioned therein. An EMI gasket 22 is mounted externally on an end portion 24 of the cage member 18. As will be described in more detail below, the EMI gasket 22 engages a latch 48 of the cage member 18 to reduce EMI emissions that leak adjacent to the latch 48. FIG. 1 illustrates the electrical connector assembly 10 without the electrical connector 20, while FIG. 2 illustrates the electrical connector 10 being held within the cage member 18. The electrical connector assembly 10 is configured to be positioned on the circuit board 16 for electrically connecting one or more pluggable electrical components 26 (FIGS. 4, 5, and 8), such as, but not limited to, small form-factor pluggable (SFP) modules, to the circuit board 16 via the electrical connector(s) 20. The end portion 24 of the cage member 18 is configured to be mounted, or received, within the opening 12 in the panel 14 that is adjacent the circuit board 16. For example, the panel 14 may be a wall of a housing of a device (not shown), such as, but not limited to, a computer, that includes the circuit board 16. In such an example, the electrical connector assembly 10 enables one or more pluggable electrical component(s) 26 located outside the housing to be electrically connected to the circuit board 16 contained within the housing.

The cage member 18 includes a body 28 extending from the end portion 24 to an opposite end portion 29. In the exemplary embodiments, the cage member body 28 includes a generally rectangular cross section, for example taken along line 1-1 of FIG. 1, and includes an upper wall 30, a lower wall 32, and side walls 34 and 36. However, the cage member body 28 may include any suitable cross-sectional shape that enables the cage member 18 to function as described and/or illustrated herein. The cage member 18 includes an internal compartment 38. The internal compartment 38 is configured to at least partially receive a pluggable electrical component 26 therein through an opening, or port, 40 at the cage member end portion 24 that communicates with the compartment 38. The cage member body 28 also includes an opening 42 extending through the lower wall 32. The opening 42 is adjacent the end portion 29 of the cage member body 28 for at least partially receiving an electrical connector 20 within the internal compartment 38 of the cage member 18. The opening 42 within the lower wall 32 of the cage member body 28 enables electrical connection between the electrical connector 20 and the circuit board 16.

Although the cage member 18 is shown as including only one internal compartment 38 and only one port 40 for electrically connecting one pluggable electrical component 26 to the circuit board 16, the cage member 18 may include any number of internal compartments 38 and ports 40, arranged in any pattern, configuration, arrangement, and/or the like (such as, but not limited to, any number of rows and/or columns), for electrically connecting any number of pluggable electrical components 26 to the circuit board 16.

The cage member 18 may have features that ground the cage member 18 to the circuit board 16, the panel 14, and/or another circuit board and/or panel. For example, the cage member body 28 may include a plurality of printed circuit board tines 44, which may both mechanically hold and ground the cage member body 28 to the circuit board 16. Additionally or alternatively, the cage member body 28 may include one or more resilient tongues 46 extending from the lower wall 32 to provide grounding of the cage member body 28 to the circuit board 16. The cage member body 28 may optionally include kick-out springs 183 to facilitate removing the electrical connectors 20 from the body 28.

The cage member 18 includes a latch 48 that cooperates with a latch element 49 (FIG. 4) of the pluggable electrical component 26 to latch the pluggable electrical component 26 to the cage member 18. Optionally, the latch 48 also facilitates grounding the pluggable electrical component 26 to the cage member 18. The latch 48 may have any suitable size, shape, structure, means, configuration, arrangement, and/or the like that enables the latch 48 to cooperate with the latch element 49 to latch the pluggable electrical component 26 to the cage member 18. In the exemplary embodiments, the latch 48 is a spring latch that includes an extension 50 having an opening 52 therein that receives an extension 53 (FIG. 4) of the latch element 49. When the extension 50 is engaged with the latch element 49, the extension 50 is deflected and the natural bias of the extension 50 facilitates maintaining the extension 53 of the latch element 49 within the opening 52. The opening 52 may have any suitable size and/or shape that enables the opening 52 to function as described and/or illustrated herein. Although the latch 48 is located on the lower wall 32 of the cage member 18, the latch 48 may be located on any of the walls 30, 32, 34, and/or 36, and/or any internal divider walls (not shown) when the cage member 18 includes more than one compartment 38 for receiving more than one pluggable electrical component 26. Moreover, in the exemplary embodiments the latch 48 is located adjacent the port 40. However, the latch 48 may be located anywhere on the cage member body 28 that enables the latch 48 to function as described and/or illustrated herein.

Figure 3:
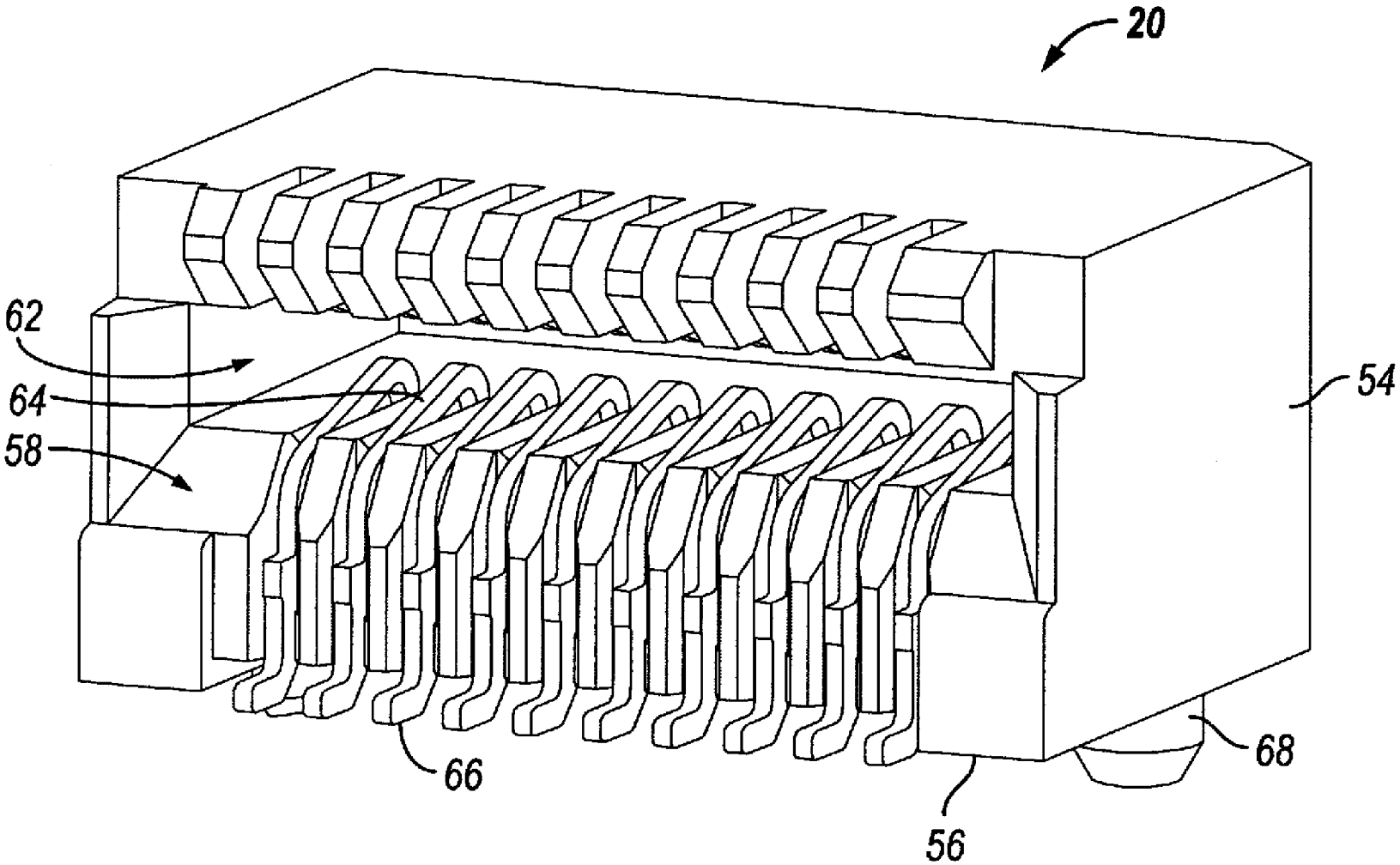
FIG. 3 is a perspective view of an exemplary embodiment of an electrical connector of the electrical connector assembly shown in FIGS. 1 and 2.
Figure 4:
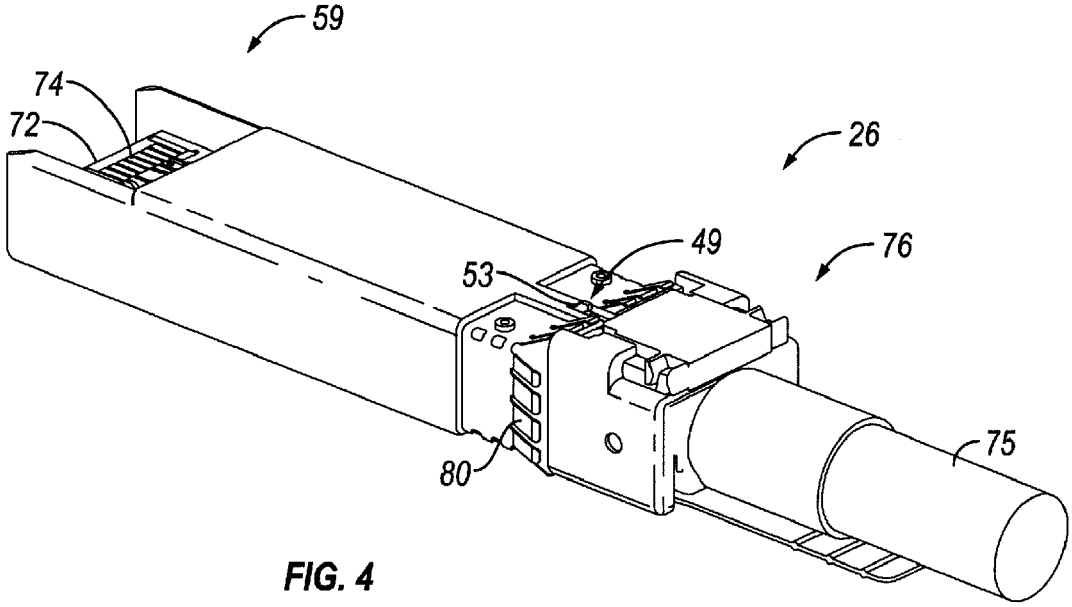
FIG. 4 is a perspective view of an exemplary embodiment of a pluggable electrical component for use with the electrical connector assembly shown in FIGS. 1 and 2.
Figure 5:
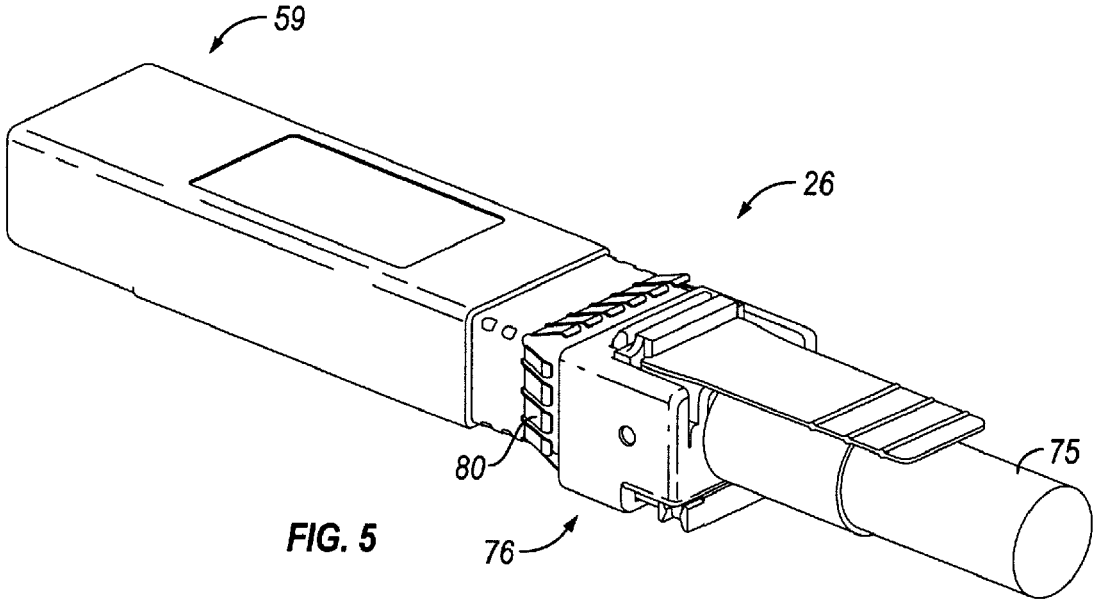
FIG. 5 is another perspective view of the pluggable electrical component shown in FIG. 4.
Figure 8:
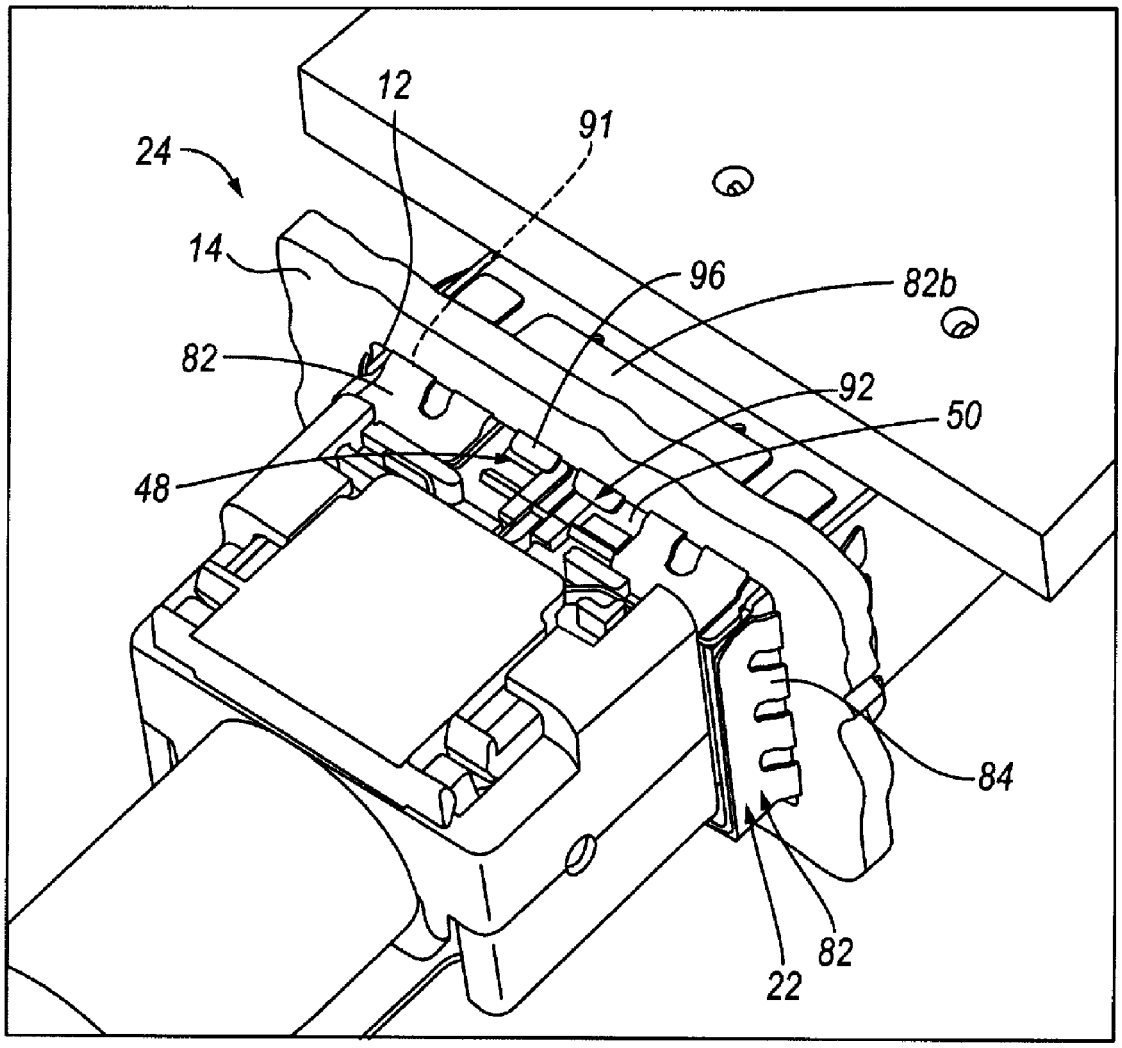
FIG. 8 is a perspective view of a portion of the electrical connector assembly shown in FIGS. 1 and 2 illustrating an exemplary pluggable electrical component latched to the electrical connector assembly.

FIG. 3 is a perspective view of an exemplary embodiment of the electrical connector 20 of the electrical connector assembly 10. The electrical connector 20 includes a housing 54 having a lower face 56 for mating with the circuit board 16 (FIG. 2) and a mating face 58 for reception of a plug portion 59 (FIGS. 4 and 5) of the pluggable electrical component 26 (FIGS. 4, 5, and 8). The mating face 58 includes a terminal receptacle 62 that receives the plug portion 59 of the pluggable electrical component 26 therein. The terminal receptacle 62 includes one or more electrical contacts 64 that are electrically connected to corresponding electrical contacts 66 extending along the lower face 56 of the housing 54, such as, but not limited to, using electrical contacts (not shown) and/or circuit board traces (not shown) held within the housing 54. The electrical contacts 64 and 66 may each be any suitable type of electrical contact. The housing 54 optionally includes alignment posts 68 for aligning the electrical connector 20 within the cage member 18 (FIGS. 1, 2, and 8).

The electrical connector 20 can be positioned within the cage member 18 by inserting the connector 20 through the opening 42 (FIG. 1) within the cage member lower wall 32 such that the electrical contacts 66 extend through the opening 42. When the cage member 18 is positioned on the circuit board 16, the lower face 56 of the housing 54 engages the circuit board 16 such that the electrical contacts 66 extending along the lower face 56 of the housing 54 are electrically connected to the circuit board 16. When the electrical connector 20 is in place within the cage member 18, the terminal receptacle 62 is aligned for receipt of the plug portion 59 of the pluggable electrical component 26.

FIG. 4 is a perspective view of an exemplary embodiment of the pluggable electrical component 26. FIG. 5 is another perspective view of the pluggable electrical component 26. Although illustrated as a small form-factor pluggable (SFP) module, the pluggable electrical component 26 may be any suitable type of pluggable electrical component. The pluggable electrical component 26 includes the plug portion 59 for reception into the terminal receptacle 62 (FIG. 3) of the electrical connector 20 (FIG. 3). In the exemplary embodiment, the plug portion 59 includes a circuit board 72 that is received within the terminal receptacle 62 such that electrical contacts 74 held on the circuit board 72 are electrically connected to the corresponding electrical contacts 64 (FIG. 3) of the terminal receptacle 62. As such, the pluggable electrical component 26 can be electrically connected to the circuit board 16 (FIG. 2) via the electrical connector 20 held within the cage member 18 (FIGS. 1, 2, and 8). The electrical contacts 74 may each be any suitable type of electrical contact.

In the exemplary embodiment, the pluggable electrical component 26 is electrically connected to a cable 75 at an end portion 76 that is opposite the plug portion 59. Alternatively, the pluggable electrical component 26 includes an interface (not shown) for electrically connection to another component, such as, but not limited to, a modular jack (not shown) and/or the like. The pluggable electrical component 26 may include grounding tabs 80 for grounding the pluggable electrical component 26 to the cage member 18.

As discussed above, the pluggable electrical component 26 includes a latch element 49 that cooperates with the latch 48 (FIGS. 1, 2, and 8) of the cage member 18 to latch the pluggable electrical component 26 to the cage member 18.

Optionally, the latch element 49 also facilitates grounding the pluggable electrical component 26 to the cage member 18. The latch element 49 may have any suitable size, shape, structure, means, configuration, arrangement, and/or the like that enables the latch element 49 to cooperate with the latch 48 to latch the pluggable electrical component 26 to the cage member 18. In the exemplary embodiments, the latch element 49 includes an arm (not shown) that is movable between a latched and an unlatched position. The arm includes the extension 53, which in the latched position is received within the opening 52 (FIGS. 1 and 2) of the latch 48. The extension 53 may have any suitable size and/or shape that enables the extension 53 to function as described and/or illustrated herein. The latch element 49 may be located anywhere on the pluggable electrical component 26 that enables the latch element 49 to cooperate with the latch 48. In addition or alternative to the extension 53 of the latch element 49 and the opening 52 of the latch 48, the latch 48 may include an extension (not shown) that is received within an opening (not shown) of the latch element 49.

Figure 6:
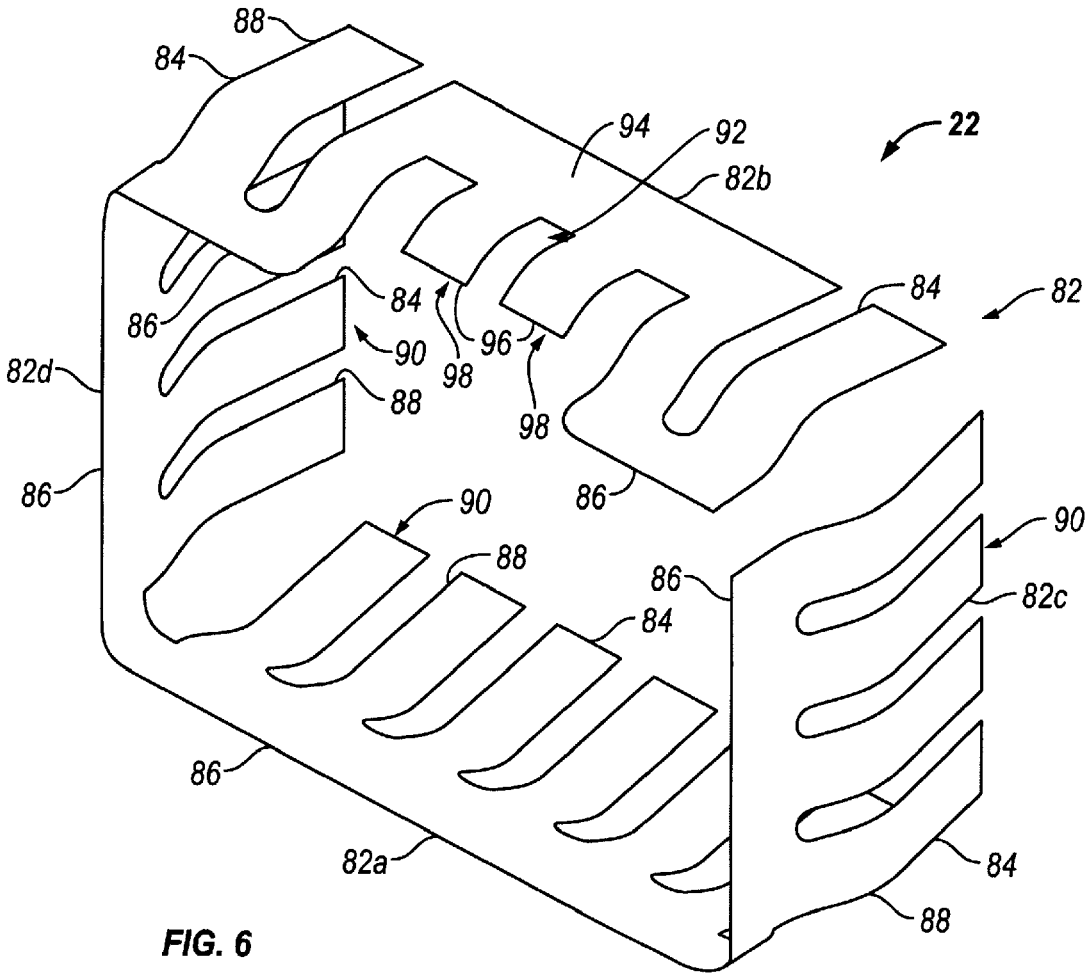
FIG. 6 is a perspective view of an exemplary embodiment of an EMI gasket of the electrical connector assembly shown in FIGS. 1 and 2.

FIG. 6 is a perspective view of an exemplary embodiment of the EMI gasket 22. In the exemplary embodiment of FIGS. 1, 2, 6, and 8, the EMI gasket 22 includes a body 82 having four sections 82*a*, 82*b*, 82*c*, and 82*d*. Each body section is configured to be mounted on the end portion 24 (FIGS. 1, 2, and 8) of the cage member 18 (FIGS. 1, 2, and 8) such that when the cage member 18 is held within the panel opening 12 (FIGS. 2 and 8), each section 82*a*, 82*b*, 82*c*, and 82*d* is engaged between the panel 14 (FIGS. 2 and 8) and a respective one of the walls 30, 32, 34, and 36 (FIGS. 1 and 2) of the cage member 18. When mounted on the cage member 18, sections 82*a*, 82*b*, 82*c*, and 82*d* of the EMI gasket body 82 form an approximately rectangular shape to generally match the rectangular cross-sectional shape of the cage member body 28. However, the body 82 may include any suitable shape that enables the EMI gasket 22 to function as described and/or illustrated herein, whether the body 82 includes a similar shape to the cage member body 28.

As can be seen in FIG. 6, in the exemplary embodiment of FIGS. 1, 2, 6, and 8, the section 82*b* is separate and distinct from the sections 82*a*, 82*c*, and 82*d*. As used herein, the term "separate and distinct" is intended to mean that the section 82*b* is not initially mechanically connected to any of the other sections 82*a*, 82*c*, and 82*d*, as shown in FIG. 6. However, when mounted on the cage member 18 as shown in FIGS. 1, 2, and 8, the separate and distinct section 82*b* may engage adjacent sections 82*c* and/or 82*d*. Moreover, once mounted on the cage member 18 as shown in FIGS. 1, 2, and 8, the separate and distinct section 82*b* may be connected to adjacent sections 82*c* and/or 82*d* using any suitable method, structure, means, and/or the like, such as, but not limited to, welding, adhesives, mechanical fasteners, and/or the like. The sections 82*a*, 82*b*, and/or 82*c* may be integrally formed, or two or more of the sections 82*a*, 82*c*, and/or 82*d* may be separately formed and connected together before being mounted on the cage member 18.

Figure 7:
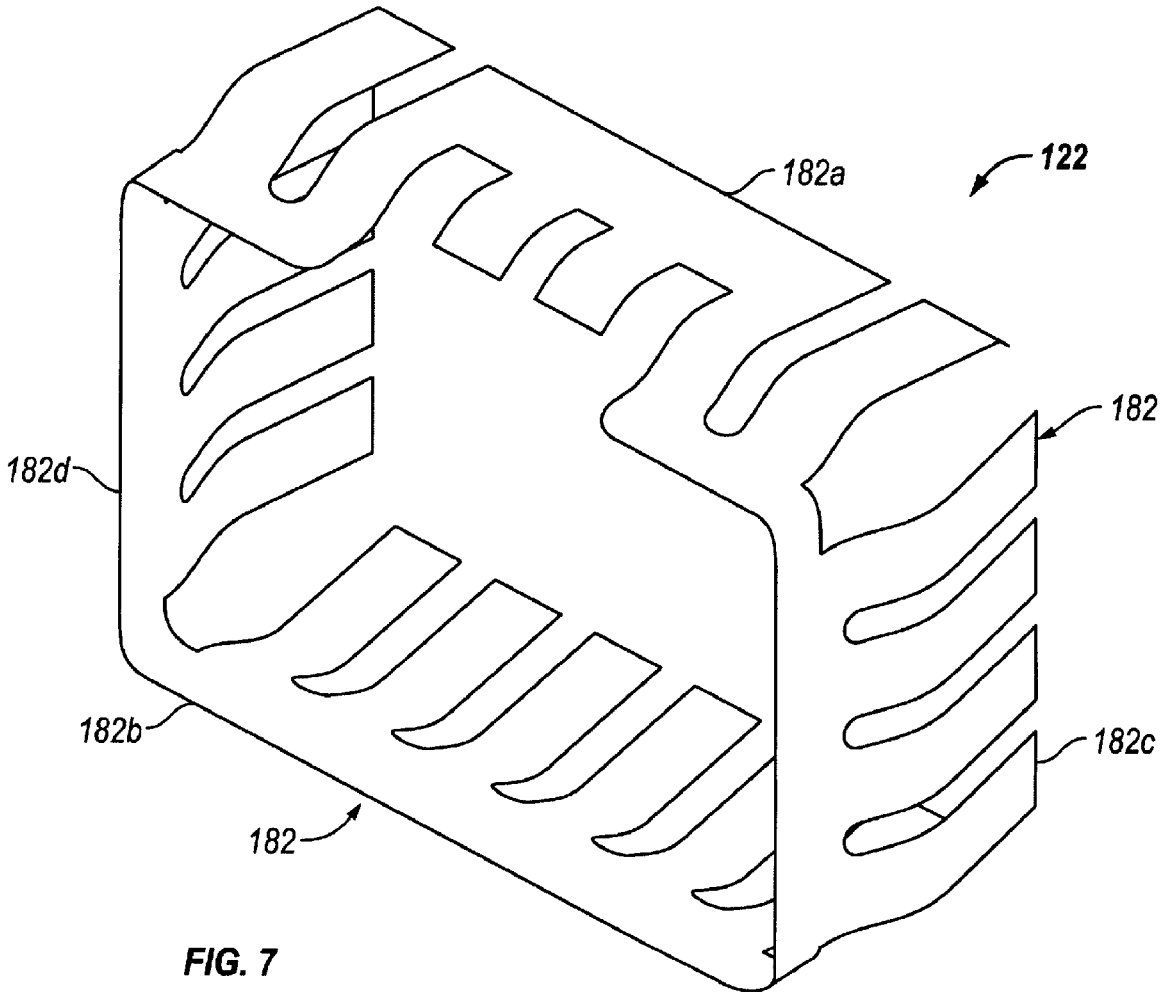
FIG. 7 is a perspective view of an exemplary alternative embodiment of an EMI gasket.

In alternative embodiments, any of the other sections 82*a*, 82*c*, and/or 82*d* may be separate and distinct from one or more adjacent sections 82*a*, 82*b*, 82*c*, and/or 82*d* before being mounted on the cage member 18. Moreover, in alternative embodiments none of the sections 82*a*, 82*b*, 82*c*, and 82*d* are provided as separate and distinct from adjacent sections. For example, FIG. 7 illustrates an alternative embodiment wherein an EMI gasket 122 includes a body 182 having four sections 182*a*, 182*b*, 182*c*, and 182*d* that are initially connected together. The body 182 may be integrally formed from each of the sections 182*a*, 182*b*, 182*c*, and 182*d*, or each of the sections 182*a*, 182*b*, 182*c*, and 182*d* may be separately formed and connected together before being mounted on the cage member 18. In the exemplary embodiment, the EMI gasket body 182 is approximately rectangular to generally match the rectangular cross-sectional shape of the cage member body 28. However, the body 182 may include any suitable shape that enables the EMI gasket 122 to function as described and/or illustrated herein, whether the body 182 includes a similar shape to the cage member body 28.

Referring again to FIG. 6, each of the sections 82*a*, 82*b*, 82*c*, and 82*d*, may have any suitable configuration, arrangement, and/or the like, and/or may include any suitable structure, means, and/or the like that enable the EMI gasket 22 to function as described and/or illustrated herein. In the exemplary embodiments, each of the sections 82*a*, 82*c*, and 82*d* includes a plurality of individual electrically conductive springs 84 that extend from a common electrically conductive base 86. Similarly, the section 82*b* includes a pair of the springs 84 that each extend from a corresponding base 86. The springs 84 each include a body 88 extending from the base 86 to a free end portion 90. The individual springs 84 may be integrally formed with the base 86, or may be fabricated separately from the corresponding base 86 and thereafter connected thereto using any suitable method, structure, means, and/or the like, such as, but not limited to, welding, adhesives, mechanical fasteners, and/or the like. The body 88 of each of the springs 84 is configured to engage a surface 91 (FIGS. 2 and 8) defining the panel opening 12 to electrically connect the springs 84, and therefore the base 86, to the panel 14. Although each of the sections 82*c* and 82*d* includes four springs 84, the section 82*a* includes six springs 84, and the second 82*b* includes two springs 84, each of the sections 82*a*, 82*b*, 82*c*, and 82*d* may include any number of springs 84.

When mounted on the cage member 18, the base 86 of each of the sections 82*a*, 82*b*, 82*c*, and 82*d* engages the respective wall 30, 32, 34, and 36 of the cage member body 28 to provide an electrical connection between the base 86 and the cage member 18. Each base 86 of each section 82*a*, 82*b*, 82*c*, and 82*d* may be mounted on the cage member 18 using any suitable configuration, arrangement, method, structure, means, and/or the like, such as, but not limited to, adhesive, frictional and/or stictional engagement (for example between the base 86 and the cage member body 28) and/or between the springs 84 and the panel 14), welding, one or more latching mechanisms, mechanical fasteners, and/or the like.

The section 82*b* of the EMI gasket body 82 includes a latch interface 92 that engages the latch 48 (FIGS. 1, 2, and 8) of the cage member 18 when the section 82*b* is mounted on the bottom wall 32 of the cage member 18. The latch interface 92 may have any suitable configuration, arrangement, and/or the like, and/or may include any suitable structure, means, and/or the like that enables the latch interface 92 to function as described and/or illustrated herein. In the exemplary embodiments, the latch interface 92 is an electrically conductive spring having a base 94 that extends from the corresponding bases 86. The nature of the spring of the latch interface 92 may facilitate accommodating movement of the latch extension 50 during latching and unlatching of the pluggable electrical component 26 to the cage member 18. A pair of extensions 96 each extend from the base 94 to a free end portion 98. When the section 82*b* is mounted on the bottom wall 32 of the cage member 18, the extensions 96 extend toward the latch 48 and the free end portions 98 each engage the extension 50 of the latch 48 such that the latch interface 92, and therefore the EMI gasket body 82, is electrically connected to the latch 48, and therefore the cage member body 28. Although the latch interface 92 includes two extensions 96, the latch interface 92 may include any number of the extensions 96.

Referring now to FIG. 8, when the EMI gasket 22 is mounted on the cage member end portion 24, the body 82 surrounds at least a portion of the cage member end portion 24. Although shown as generally completely surrounding the cage member end portion 24 in the exemplary embodiments, the EMI gasket 22 may alternatively surround only a portion of the cage member end portion 24. When the cage member end portion 24 is mounted in the panel opening 12, each of the springs 84 of the EMI gasket 22 engages the surface 91 defining the panel opening 12, thereby electrically connecting the EMI gasket 22 to the panel 14. The electrical connection between the springs 84 and the surface 91 of the panel opening 12 facilitates containing electromagnetic interference (EMI) emissions by providing a plurality of contact points that ground the cage member 18 to the panel 14. The engagement between the springs 84 and the surface 91 of the panel opening 12 also facilitates securely holding the cage member end portion 24 within the panel opening 12. Specifically, as the cage member end portion 24 is received within the panel opening 12, the surface 91 of the panel opening 12 deflects and/or deforms the springs 84 generally radially inwardly against their bias, which exerts a spring force on the surface 91 of the panel opening 12 to securely hold the cage member end portion 24 within the panel opening 12. A size, shape, material, and/or the like of the springs 84 may be selected to provide a predetermined spring force.

When the EMI gasket 22 is mounted on the cage member 18, the extensions 96 of the latch interface 92 engage the extension 50 of the latch 48 such that latch interface 92 is electrically connected to the latch 48. Via the electrical connection between the latch interface 92 and the springs 84 of the section 82*b*, the electrical connection between the latch interface 92 and the latch 48 electrically connects the cage member 18 to the panel 14 at a location adjacent the latch 48. Portions of the latch interface 92 may also engage the surface 91 of the panel opening 12 to electrically connect the cage member 18 to the panel 14 adjacent the latch 48. However, as can be seen in FIG. 2, when the cage member 18 is mounted in the panel opening 12, a gap 100 would exist between the latch 48 and the surface 91 defining the panel opening 12 if the section 82*b* did not include the latch interface 92. The gap 100 may allow EMI emissions to leak therethrough during use of the electrical connector assembly 10. As can also be seen in FIG. 8, the latch interface 92 closes at least a portion of the gap 100. The electrical connection between the latch interface 92 and the latch 48 and/or the at least partial closure of the gap 100 by the latch interface 92 facilitates containing at least some electromagnetic interference (EMI) emissions that would otherwise leak through the gap 100.

The embodiments described and illustrated herein provide an electrical connector assembly for pluggable electrical components that reduces leakage of EMI emissions in connection with spring latch members.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the subject matter described and/or illustrated herein without departing from its scope. Dimensions, types of materials, orientations of the various components, and the number and positions of the various components described and/or illustrated herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the subject matter described and/or illustrated herein should, therefore, be determined with reference to the appended claims, along with the full scope of equivalents to which such claims are entitled. In the appended claims, the terms "including" and "in which" are used as the plain-English equivalents of the respective terms "comprising" and "wherein." When introducing elements/components/etc. described and/or illustrated herein, the articles "a", "an", "the", "said", and "at least one" are intended to mean that there are one or more of the element(s)/component(s)/etc. Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

While the subject matter described and/or illustrated herein has been described in terms of various specific embodiments, those skilled in the art will recognize that the subject matter described and/or illustrated herein can be practiced with modification within the spirit and scope of the claims.

What is claimed is:

1. An electrical connector assembly comprising:

a cage member configured for mounting in an opening in a panel, the cage member having a compartment for receiving a pluggable electrical component therein, the cage member comprising a latch for cooperating with a latch element of the pluggable electrical component; and an EMI gasket mounted on the cage member such that the EMI gasket is electrically connected to the cage member, the EMI gasket configured to engage the panel when the cage member is mounted in the opening in the panel, wherein the EMI gasket comprises a latch interface that engages the latch such that the latch interface is electrically connected to the latch.

2. The electrical connector assembly of claim 1, wherein the latch interface comprises a spring.

3. The electrical connector assembly of claim 1, wherein the latch interface comprises an extension that engages the latch.

4. The electrical connector assembly of claim 1, wherein the latch interface closes at least a portion of a gap between the latch and the panel when the cage member is mounted in the opening in the panel.

5. The electrical connector assembly of claim 1, wherein at least a portion of the latch extends within the compartment of the cage member.

6. The electrical connector assembly of claim 1, wherein the EMI gasket comprises at least two separate and distinct sections.

7. The electrical connector assembly of claim 1, wherein the latch comprises a surface that is exposed within the compartment of the cage member.

8. The electrical connector assembly of claim 1, wherein the latch is adjacent a port that communicates with the compartment of the cage member.

9. The electrical connector assembly of claim 1, wherein the latch is a spring latch.

10. The electrical connector assembly according to claim 1, wherein the cage member and the EMI gasket each comprise an approximately rectangular cross section.

11. An electrical connector assembly comprising:

a cage member configured for mounting in an opening in a panel, the cage member having a compartment for receiving a pluggable electrical component therein, the cage member comprising a latch for cooperating with a latch element of the pluggable electrical component;

an electrical connector at least partially enclosed by the cage member, the electrical connector configured to electrically connect to the pluggable electrical component when the pluggable electrical component is received within the compartment; and an EMI gasket mounted on the cage member such that the EMI gasket is electrically connected to the cage member, the EMI gasket configured to engage the panel when the cage member is mounted in the opening in the panel, wherein the EMI gasket comprises a latch interface that engages the latch such that the latch interface is electrically connected to the latch.

12. The electrical connector assembly of claim 11, wherein the latch interface comprises a spring.

13. The electrical connector assembly of claim 11, wherein the latch interface comprises an extension that engages the latch.

14. The electrical connector assembly of claim 11, wherein the latch interface closes at least a portion of a gap between the latch and the panel when the cage member is mounted in the opening in the panel.

15. The electrical connector assembly of claim 11, wherein at least a portion of the latch extends within the compartment of the cage member.

16. The electrical connector assembly of claim 11, wherein the EMI gasket comprises a plurality of separate and distinct sections.

17. The electrical connector assembly of claim 11, wherein the latch comprises a surface that is exposed within the compartment of the cage member.

18. The electrical connector assembly of claim 11, wherein the latch is adjacent a port that communicates with the compartment of the cage member.

19. The electrical connector assembly of claim 11, wherein the latch is a spring latch.

20. The electrical connector assembly according to claim 11, wherein the cage member and the EMI gasket each comprise an approximately rectangular cross section.

21. The electrical connector assembly of claim 1, further comprising the pluggable electrical component, wherein the latch of the cage member is engaged with the latch element of the pluggable electrical component.

22. The electrical connector assembly of claim 11, further comprising the pluggable electrical component, wherein the latch of the cage member is engaged with the latch element of the pluggable electrical component.

* * * * *